US005438869A

United States Patent [19]

Mueller et al.

[11] Patent Number: 5,438,869

[45] Date of Patent: Aug. 8, 1995

[54] PROTECTIVE REED SWITCH HOUSING

[75] Inventors: Dennis R. Mueller, Granite Bay; Donald R. Sandell, San Jose, both of Calif.

[73] Assignee: C & K Systems, Inc., Folsom, Calif.

[21] Appl. No.: 137,499

[22] Filed: Oct. 15, 1993

Related U.S. Application Data

[63] Continuation-in-part of Ser. No. 798,492, Nov. 26, 1991, Pat. No. 5,254,965.

[51] Int. Cl.[6] ..... H01H 1/66

[52] U.S. Cl. ..... 73/431; 29/622; 335/202; 335/153; 335/154

[58] Field of Search ..... 73/431; 200/61.62; 340/547, 551; 361/142, 357; 335/17, 156, 202, 278, 193, 16, 195, 147, 179, 151, 153, 154; 324/179; 29/622, 854

[56] References Cited

U.S. PATENT DOCUMENTS

| | | | |
|---|---|---|---|
| 2,904,656 | 9/1959 | Harry | 200/89 |
| 2,923,791 | 2/1960 | Corbitt et al. | 200/87 |
| 3,059,075 | 10/1962 | Peek, Jr. | 335/154 |
| 3,246,095 | 4/1966 | Barton | 29/622 |
| 3,250,875 | 5/1966 | Wintriss | 200/87 |
| 3,254,327 | 5/1966 | Freimanis et al. | 335/153 |
| 3,771,083 | 11/1973 | Wessel | 335/153 |
| 3,967,224 | 6/1976 | Seeley | 335/153 |
| 4,005,295 | 1/1977 | Mitchell et al. | 200/61.62 |
| 4,165,501 | 8/1979 | Bongort et al. | 335/206 |
| 4,213,110 | 7/1980 | Holce | 335/207 |
| 4,246,457 | 1/1981 | Teichert et al. | 200/303 |
| 4,371,856 | 2/1983 | Holce et al. | 335/202 |
| 4,943,791 | 7/1990 | Holce et al. | 335/153 |
| 5,004,879 | 4/1991 | Bernhardt et al. | 200/295 |

*Primary Examiner*—Robert Raevis
*Attorney, Agent, or Firm*—Limbach & Limbach

[57] ABSTRACT

A reed switch assembly and method of assembling it are disclosed. A preferred embodiment of the reed switch assembly includes an elongate hollow housing having an opening at one end thereof for access to a cavity therein. A reed switch is positioned completely inside the cavity. The first and second connecting leads of the reed switch are bent so that they are each substantially parallel to their respective first and second reeds and so that they lie in planes that are not coplanar with the flat portions of the first and second reeds. The first connecting lead has a length that is long enough so that it extends at least half-way over the reed switch body towards the second connecting lead. A first wire is attached to the first connecting lead at a connection point that is spaced apart from the free end of the first connecting lead a distance equal to at least one-half the total length of the first connecting lead. An ameliorator magnet is mounted on the first connecting lead between the free end and the connection point to create a magnetic circuit between itself and the first and second reeds in order to reduce the magnetic flux density required to close the first and second reeds. A substantially flat, circular, blocking member is positioned inside the cavity between the reed switch body and the housing opening. The blocking member provides support for the reed switch and substantially centers the reed switch in the housing cavity. Fillant is positioned in the cavity at the housing opening for substantially closing the housing opening.

25 Claims, 5 Drawing Sheets

PROTECTIVE REED SWITCH HOUSING

CROSS REFERENCE TO RELATED APPLICATION

This application is a continuation-in-part of U.S. Ser. No. 07/798,492, filed Nov. 26, 1991, and entitled "Protective Reed Switch Housing", now U.S. Pat. No. 5,254,965.

BACKGROUND OF THE INVENTION

1. Field of the Invention

The present invention relates to magnetic contacts for use in intrusion detection systems, and more particularly, to a protective housing for enclosing a reed switch.

2. Description of the Related Art

Intrusion detection systems, such as those used in burglar alarms, typically include two basic components: an intrusion detector and an intrusion indicator. An intrusion detector is used to monitor a given situation and provide information needed in determining whether an abnormal condition exists, such as the presence of an intruder. An intrusion indicator analyzes information received from an intrusion detector and determines whether an intrusion has occurred. If an intrusion has occurred, then the intrusion indicator generates some type of warning signal, such as flashing lights, ringing bells, or in more modern systems, a digital signal transmitted via telephone lines to a security system computer.

One type of intrusion detector is a metallic tape that is placed across all door and door frames and window and window frames of a building. The tape has an electric current passing through it which causes the intrusion indicator to determine that no intrusion has occurred. Any intruder entering the building will break the tape which will interrupt the current. The intrusion indicator will interpret the current interruption as indicating that an intrusion has occurred.

Another type of intrusion detector is a magnetic contact. A magnetic contact often includes a dry-reed switch (or simply "reed switch"), and an external magnet. FIG. 1 illustrates a reed switch 10. The switch 10 consists of two thin, metallic strips (or "reeds") 12 and 14 that are hermetically sealed in a delicate glass tube-like body 16. The glass body 16 is filled with an inert gas. Each of the reeds 12 and 14 is connected to a respective connecting lead 18 and 20.

When an external magnet is brought near the switch 10, the magnet attracts one of the reeds 12 or 14, which then contacts the other reed 12 or 14. When the reeds 12 and 14 come into contact, the circuit which is connected to the connecting leads 18 and 20 closes.

When used as an intrusion detector, the reed switch 10 and external magnet operate in a manner similar to the metallic tape detector. The switch 10 is usually installed in a hole in the wooden frame above a door. The external magnet is mounted on the door at a location which is near the switch 10 when the door is closed. When the door is closed, the reeds make contact due to the presence of the magnet, and current passes through the switch 10. When the door is opened, such as by an intruder, the external magnet is moved away from the switch 10 which causes the reeds to separate, and thus, the current is interrupted.

Before insertion into a hole of a wooden door frame, the reed switch 10 is typically enclosed within a cylindrical plastic housing in order to protect its delicate glass body 16. The cylindrical plastic housing has one open end and is generally long enough to enclose the entire length of the switch, as well as a short portion of the wires which are coupled to the connecting leads.

The reed switch must be secured within the plastic housing so that it cannot be pulled out during installation. Securing the switch within the housing, however, presents more of a problem than appears at first blush. Because the reed switch is a magnetic device, it cannot be secured in the housing with any type of metallic fastener because the metal would interfere with the operation of the switch. Furthermore, the reed switch is a delicate and very tiny device, often having a glass body length of only 0.53 inches. Thus, it cannot be secured in the housing by means of plastic screws, bolts, rivets, or like plastic fasteners because these fasteners are too large and would destroy the switch.

Therefore, after the reed switch has been inserted into the plastic housing, it has traditionally been secured by filling the entire housing with a fillant, typically epoxy adhesive. Since the epoxy is not metallic, it does not interfere with the operation of the switch. Since the epoxy is initially in liquid form, it does not harm the delicate switch. The entire housing can be quickly and easily filled with the liquid epoxy; this is a particularly advantageous quality because it has always been thought that filling the entire housing provided the best and most secure method of holding the switch in the housing. After it is hardened, the epoxy surrounds the entire switch such that there is no room for movement.

While the above method initially works well in securing a reed switch, it has been found that after a switch and housing have been implanted in a wooden door frame for a period of time, the switch often malfunctions. The malfunction is normally due to the glass body of the switch becoming cracked or broken. A reed switch will not function with a cracked or broken glass body.

Another problem that has arisen with the reed switch 10 relates to the closeness with which an external magnet must be brought near the reed switch 10 in order to cause the reeds 12 and 14 to make contact. Normally, the distance between an external magnet and the reed switch 10 must be less than one inch for the reeds 12 and 14 to make contact. If an error is made during installation in the positioning of the reed switch 10, external magnet, or both, the external magnet may not be able to get close enough to the reed switch 10 for the reeds 12 and 14 to make contact. Such an error in installation would prevent the reed switch from functioning.

Thus, there has emerged a compelling need for a reed switch housing which will protect the glass body of a reed switch from becoming cracked or broken over long periods of time, and for a reed switch assembly that will function properly even when small positioning errors occur during installation.

SUMMARY OF THE INVENTION

The present invention provides a reed switch assembly that includes an elongate hollow housing having an opening at one end thereof for access to a cavity therein. A reed switch having a body, a first connecting lead having one end connected to a first flat reed and another end free, and a second connecting lead having one end connected to a second flat reed and another end free, is positioned completely inside the cavity. The first connecting lead is bent so that it is substantially parallel to the first reed and so that it lies in a plane that is not coplanar with the flat portion of the first reed. First and second wires are attached to the first and second connecting leads, respectively. The first wire is attached to the first connecting lead at a connection point that is spaced apart a distance from the free end of the first connecting lead. The first and second wires extend through the opening in the housing. A blocking member is positioned inside the cavity between the reed switch body and the housing opening to define a space between itself and the housing opening. The first and second wires extending through the blocking member. The blocking member provides support for the reed switch and substantially centers the reed switch in the housing cavity. Fillant is positioned in the cavity at the housing opening for substantially closing the housing opening. The fillant extends into the cavity up to the blocking member and surrounds the first and second wires to suspend the reed switch in the cavity such that the reed switch body and the first and second connecting leads do not make contact with the housing. The blocking member prevents the fillant from contacting the reed switch body.

The present invention also provides a method for enclosing a reed switch within an elongate hollow protective housing having an open end. The reed switch has a body, a first connecting lead, and a second connecting lead with the first and second connecting leads having corresponding first and second wires attached thereto. The first and second wires are surrounded with a blocking member in the vicinity of the first connecting lead. The reed switch is inserted, second connecting lead first, into the open end of the protective housing. The reed switch and the blocking member are pushed into the protective housing until the body and the blocking member are positioned completely within the protective housing, and so that the blocking member defines a space between itself and the open end of the protective housing. The space between the blocking member and the open end of the protective housing are substantially filled with a fillant.

In another embodiment, the present invention provides a method for enclosing a reed switch within an elongate hollow protective housing having an open end. The reed switch has a body, a first connecting lead having one end connected to a first flat reed and another end free, and a second connecting lead having one end connected to a second flat reed and another end free. The first and second connecting leads are bent so that they are each substantially parallel to their respective first and second reeds and so that they lie in planes that are not coplanar with the flat portions of the first and second reeds. A first wire is attached to the first connecting lead at a connection point that is spaced apart a distance from the free end of the first connecting lead. A second wire is attached to the second connecting lead. The first and second wires are inserted through a blocking member that is positioned on the same side of the reed switch body as the first connecting lead. The reed switch is inserted, second connecting lead first, into the open end of the protective housing. The reed switch and the blocking member are pushed into the protective housing until the reed switch body and the blocking member are positioned completely within the protective housing, and so that the blocking member defines a space between itself and the open end of the protective housing. The space between the blocking member and the open end of the protective housing are substantially filled with a fillant.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE PREFERRED EMBODIMENT

It is believed that the wood in a door frame in which a reed switch plastic housing is installed goes through many cycles of expansion and contraction over the course of a year. These expansions and contractions tend to place stress on the plastic housing. If the entire plastic housing is filled with hardened epoxy which totally encases the switch, the stress on the housing is transferred to the switch's delicate glass body which can cause it to crack or break.

One may initially think that this problem can be solved by only partially filling the plastic housing; in other words, provide only enough liquid epoxy to fill about one-half of the housing from the closed end to the open end. This solution, however, will not solve the problem. Because the connecting leads of the switch are fairly short, the glass body of the switch will be close to the closed end of the housing. Therefore, even a small amount of epoxy will come into contact with the glass body. Having any part of the glass body in contact with the epoxy may result in breaking the glass.

Figure 1:
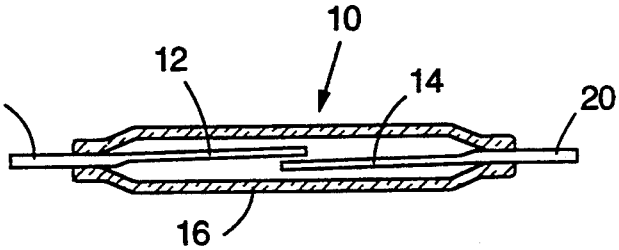
(PRIOR ART) FIG. 1
FIG. 1 is an illustration of a prior art reed switch.
Figure 2:
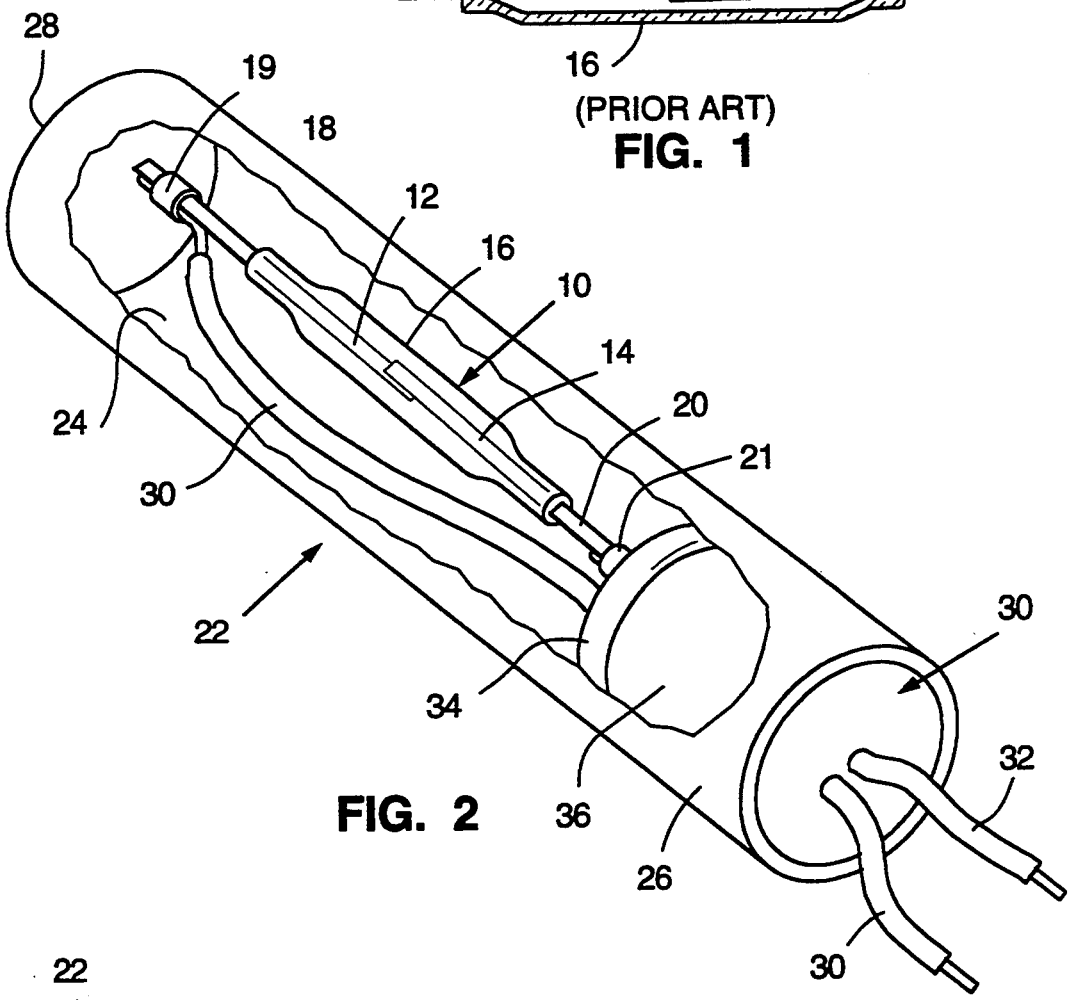
FIG. 2 is a cut-away perspective view of a protective reed switch housing in accordance with the present invention.
Figure 3:
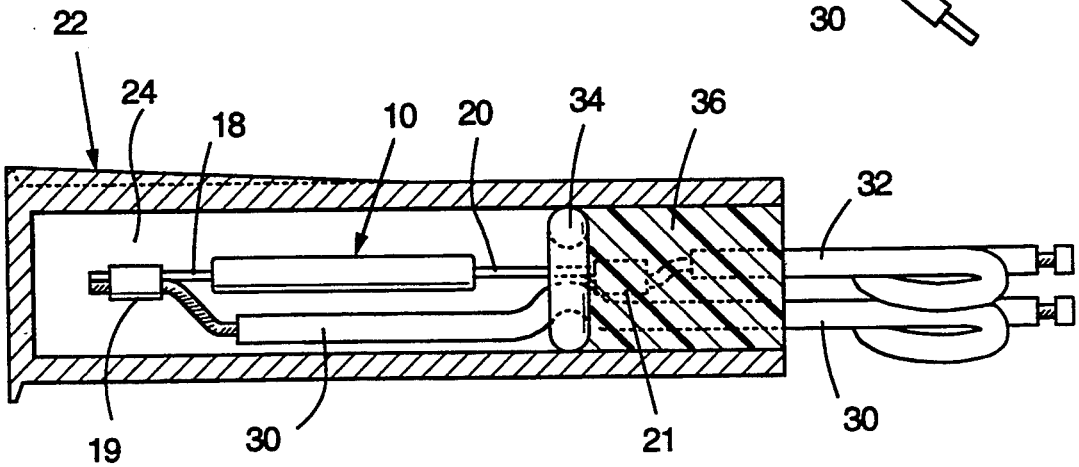
FIG. 3 is a cross-sectional view of the protective reed switch housing of FIG. 2.
Figure 4A:
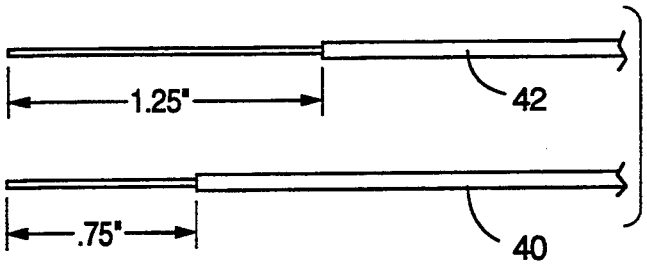
FIGS. 4(A) through 4(F) are perspective views illustrating a method of coupling wires to the connecting leads of a reed switch, as well as insertion of the reed switch into a housing in accordance with the present invention.
Figure 4B:
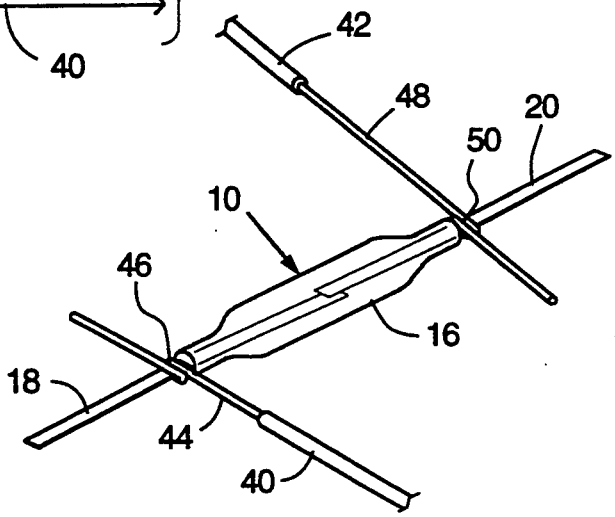
Figure 4C:
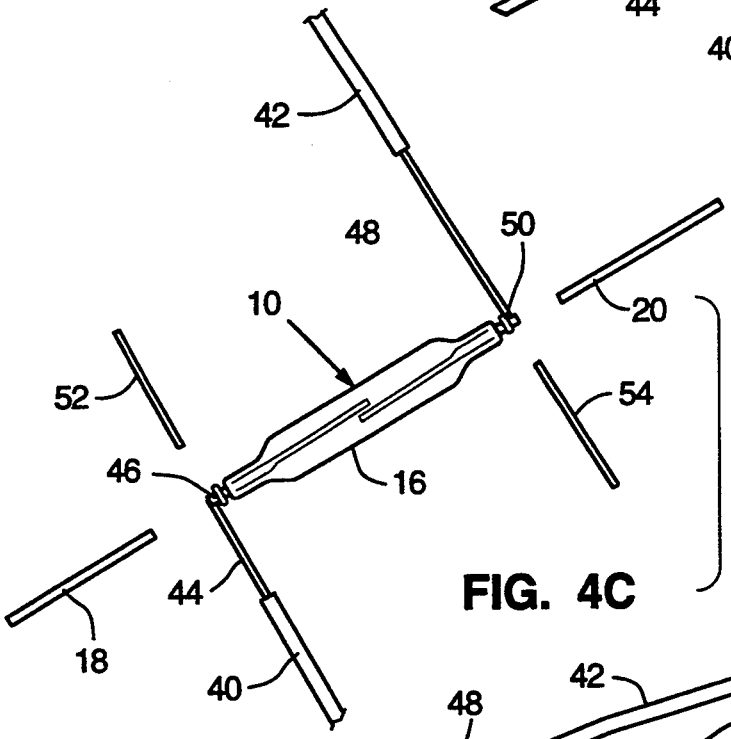
Figure 4D:
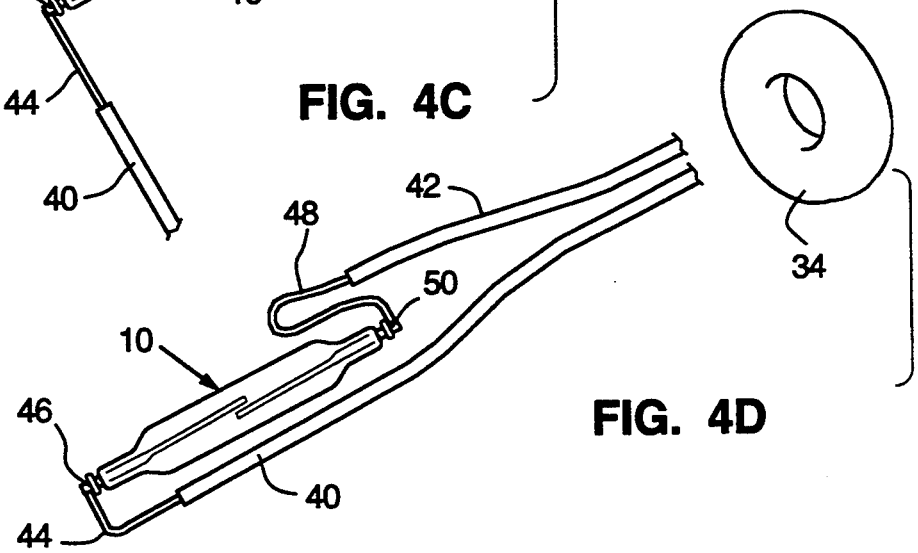
Figure 4E:
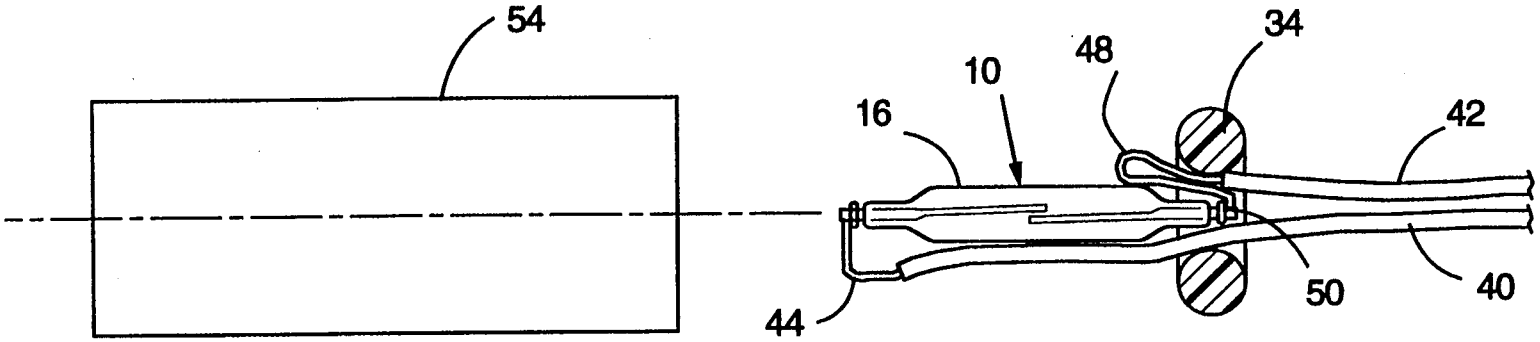
Figure 4F:
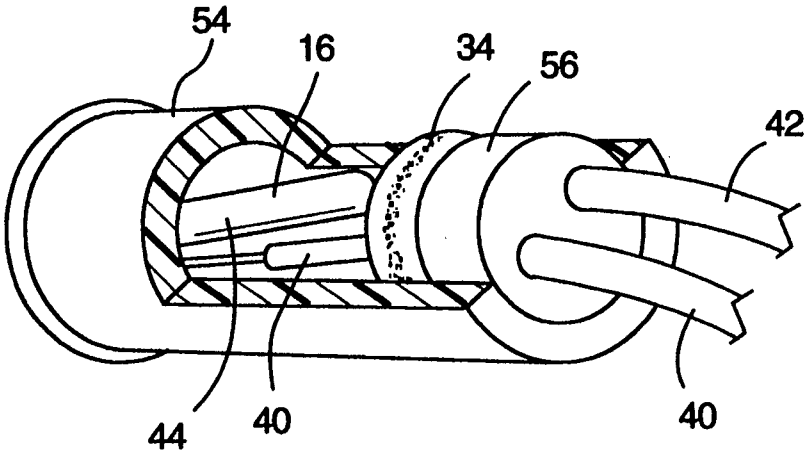

FIGS. 2 and 3 illustrate one embodiment of a protective reed switch housing 22 in accordance with the present invention. A prior art reed switch 10 is enclosed within a cavity 24 of a cylindrical, hollow, plastic housing member 26. In this embodiment, the housing member 26 has an inside diameter of 0.2598 inches, a length of 1.25 inches, and is constructed from ABS plastic. Furthermore, the reed switch 10 is preferably part no. R1-07AAAdry-reed switch manufactured by Philips Components of the Netherlands. Its glass body 16 has a length of 0.53 inches and a width of 0.071 inches.

The cavity 24 should be large enough such that if the switch 10 is suspended in the center of the cavity 24, the cavity walls will not make contact with the glass body 16. The housing 26 should be long enough to enclose the entire length of the switch 10, as well as a short portion of the wires 30 and 32 which are coupled to the connecting leads 18 and 20. The housing 26 has a closed end 28 and an open end 30.

While other methods may be used to couple wires 30 and 32 to connecting leads 18 and 20, in the embodiment shown in FIGS. 2 and 3, these wires are coupled to the connecting leads by means of crimping and soldering. A brass crimp connector 19 is used to couple wire 30 to connecting lead 18. Solder is then applied to the ends of crimp connector 19 to insure strength and a good electrical connection. Similarly, a brass crimp connector 21 is used to couple wire 32 to connecting lead 20. Solder is applied to the ends of crimp connector 21 as well.

A blocking member 34 is placed around the wires 30 and 32. As the switch 10 is inserted into the open end 30 of the housing 26, the blocking member 34 is positioned inside the cavity 24 a short distance from the open end 30. The blocking member 34 has a hole, preferably at its center, to allow the wires 30 and 32 to pass through.

An O-ring, grommet, or the like, may be used as the blocking member 34. In the preferred embodiment, a 0.25 inch outside diameter and 0.125 inch inside diameter #006 nitrile (BUNA-70) O-ring manufactured by Parker Co. of Irvine, Calif. is used for the blocking member 34.

The blocking member 34 seals off the open end 30 of the housing 26 from the switch 10. Furthermore, the blocking member 34 defines a space between itself and the open end 30. This space is filled with a fillant 36. The fillant 36 may be epoxy adhesive, or the like. In the preferred embodiment, DP-420 Scotch-Weld® off-white epoxy adhesive (3M I.D. no.: 62-3280-1435-2) manufactured by 3M Co. of St. Paul, Minn. is used as the fillant 36. This epoxy is applied to the housing 26 with a 3M Scotch-Weld® EPX applicator and mixing gun.

The blocking member 34 prevents the fillant 36 from coming into contact with the glass body 16 of the switch 10. Because, the switch 10 is surrounded by an air filled cavity 24 rather than epoxy, mechanical stresses on the housing 26 do not effect the glass body 16.

In the preferred embodiment, the blocking member 34 is positioned very close to the glass body 16, provided that no fillant 36 is permitted to make contact with the glass body 16. If the hardened fillant 36, which surrounds the wires 30 and 32, is very close to the glass body 16, the fillant 36 will tend to suspend the switch 10 in the center of the cavity 24 such that no part of the switch 10 makes contact with the cavity walls. While suspending the switch 10 in the center of the cavity 24 is preferred, it is not necessary. The switch 10 will function properly if it is permitted to rest on the cavity walls. The main concern is that no fillant 36 makes contact with the glass body 16.

FIGS. 4(*a*)–(*f*) illustrate an alternative embodiment of the protective reed switch housing in accordance with the present invention. This embodiment uses a shorter housing and an alternative method of coupling the wires to the connecting leads of the reed switch.

Referring to FIG. 4(*a*), about 1.25 inches of insulation is removed from a wire 42, and about 0.75 inches of insulation is removed from another wire 40. More insulation is removed from wire 42 because, as will be discussed below, a "180° double-back" will be formed out of the exposed conductor. The wire used for wires 40 and 42 is preferably twenty-two gauge regular braided wire.

The exposed conductor of wire 40 is wrapped 360° around connecting lead 18 of the switch 10 forming a wrapped wire joint 46, as illustrated by FIG. 4(*b*). Plenty of exposed conductor 44 should be left between the wrapped wire joint 46 and the insulation of wire 40. The wrapped wire joint 46 should be pushed up against the glass body 16. Similarly, the exposed conductor of wire 42 is wrapped 360° around connecting lead 20 forming a wrapped wire joint 50. Plenty of exposed conductor 48 should be left between the wrapped wire joint 50 and the insulation of wire 42. The wrapped wire joint 50 is pushed up against the glass body 16.

Solder is applied to the wrapped wire joints 46 and 50 in order to solder the joints to the connecting leads 18 and 20, respectively. Care should be used to insure that no solder is applied to the exposed conductors 44 and 48 because these conductors are to be bent.

Referring to FIG. 4(*c*), the excess portions of connecting leads 18 and 20 are cut off at a point close to the wrapped wire joints 46 and 50. The excess exposed conductors 52 and 54 of wires 40 and 42 are also cut off at a point close to the wrapped wire joints 46 and 50. The length of each wrapped wire joint 46 and 50 should preferably be about 0.08 inches; this length is measured from the end of the glass body 16 to the end of each respective wrapped wire joint. Because the length of the glass body 16 of the switch 10 is about 0.53 inches, the overall length of the glass body 16 and the wrapped wire joints 46 and 50 should preferably be a maximum of 0.70 inches.

FIG. 4(*d*) illustrates that the exposed conductor 44 of wire 40 is carefully bent 90° so that the insulated portion of wire 40 extends parallel to the switch 10. The exposed conductor 48 of wire 42 is first carefully bent 90° towards the other end of the switch 10, and then is carefully bent back 180° in the opposite direction. This is referred to as a "180° double-back" and its purpose is to position the start of the insulation of wire 42 next to the wrapped wire joint 50. Because this embodiment uses a shorter housing than the embodiment discussed above, the 180° double back will insure that all of the exposed conductor 48 is kept inside the housing. Furthermore, the 180° double back relieves the stress that the exposed conductor 48 places on the wrapped wire joint 50.

FIG. 4(*e*) illustrates the switch 10 with the blocking member 34 in place. The blocking member 34 is preferably positioned over a portion of the 180° double back 48 with the wrapped wire joint 50 at about the center of the hole through the blocking member 34. Once the blocking member 34 is in place, the switch 10 is ready to be inserted into a cylindrical hollow plastic housing 54.

The housing 54 is shorter than the housing 26 used in the embodiment discussed above. The housing 54 preferably has length of 0.75 inches, an inside diameter of 0.2598 inches, and is constructed from ABS plastic. Because the housing 54 has the same inside diameter as the housing 26, the same preferred O-ring mentioned above can be used for the blocking member 34.

After the switch 10 and blocking member 34 combination are inserted into the housing 54, the space between the blocking member 34 and the open end of the housing 54 is filled with a fillant. FIG. 4(*f*) is a cross-sectional perspective view illustrating a fillant 56 positioned in the space between the blocking member 34 and the open end of the housing 54. The preferred fillant and device used to apply it are the same as was discussed above. The switch 10 is preferably suspended in the center of the housing 54 without contacting the housing walls, but this suspension is not necessary. It is believed that the switch 10 will function just as well if it rests on the inside walls of the housing 54.

One advantage of the embodiment shown in FIGS. 4(*a*)–(*f*) over the embodiment shown in FIGS. 2 and 3 is that the final length of the connecting leads 18 and 20 of the switch 10 are shorter in the embodiment of FIGS. 4(*a*)–(*f*). This is advantageous for two reasons. First, the shorter the connecting leads 18 and 20, the shorter the housing. Second, stress on the connecting leads 18 and 20 relative to the delicate glass body 16 can cause the glass to crack or break. Shorter connecting leads 18 and 20 are less likely to be subject to stress.

The method of encapsulating a reed switch disclosed herein provides for a very long life of the switch while adequately securing the switch within the plastic housing.

Figure 5:
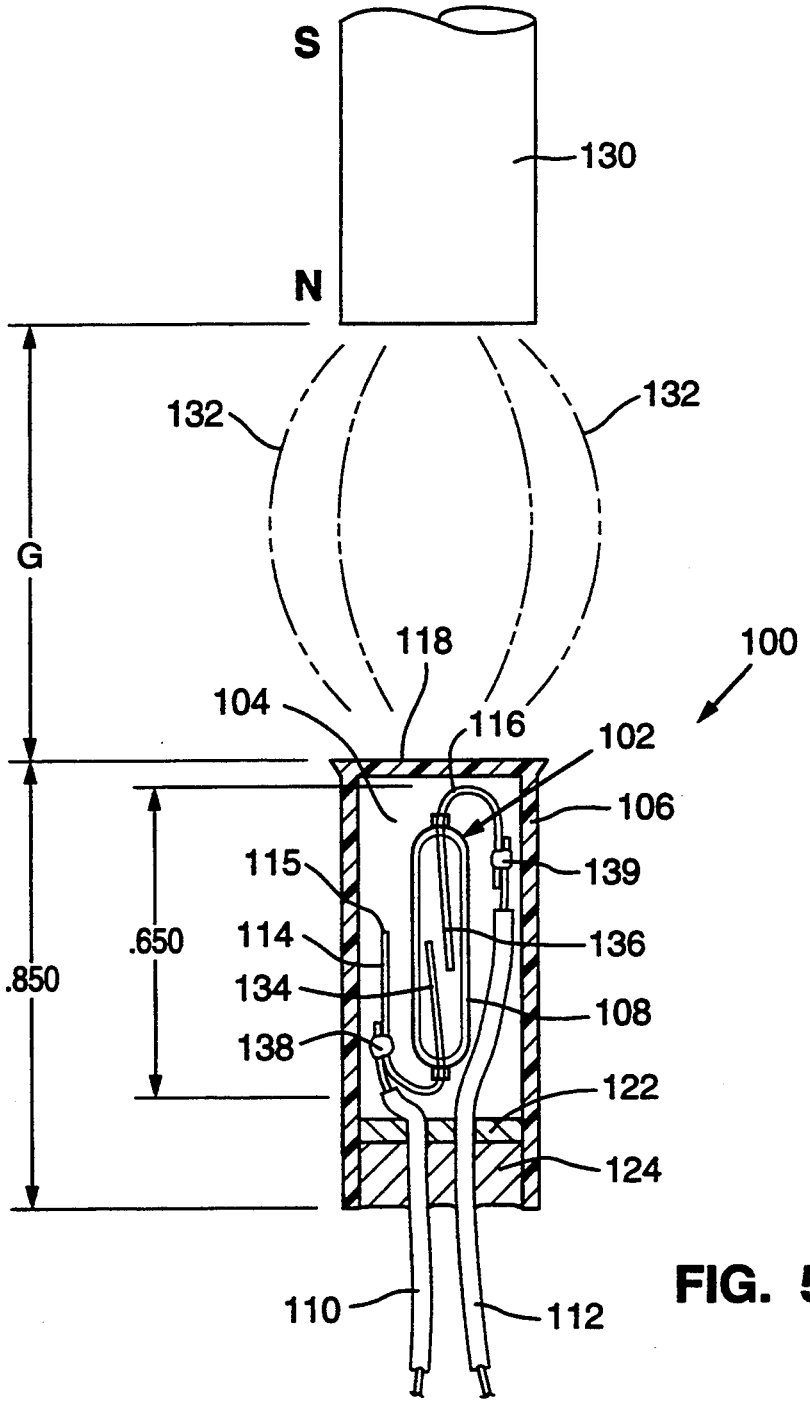
FIG. 5 is a cross-sectional view illustrating a protective reed switch housing in accordance with the present invention.

The protective reed switch housing 22 described above was disclosed in the parent application cross-referenced herein. FIG. 5 illustrates a protective reed switch housing 100 in accordance with the present invention. A reed switch 102 is enclosed within the cavity 104 of a cylindrical, hollow, plastic housing member 106. The housing 106 has a closed end 118 and an open end 120. In this embodiment, the housing member 106 preferably has a length of 0.850 inches, an inside diameter of 0.2598 inches, and is constructed from ABS plastic. Thus, the housing member 106 is more compact than the housing member 26 discussed above.

The reed switch 102 is preferably a part no. ORD9215 dry-reed switch manufactured by Oki Components of Japan. Its glass body 108 has a length of 0.670 inches.

Similar to the protective reed switch housing 22 discussed above, a blocking member 122 is positioned inside the cavity 104 a short distance from the open end 120. The blocking member 122 seals off the open end 120 of the housing 106 from the switch 102. The space between the blocking member 122 and the open end 120 is filled with a fillant 124. The fillant 124 may be epoxy adhesive, or the like. In the preferred embodiment, DP-420 Scotch-Weld ® off-white epoxy adhesive (3M I.D. no.: 62-3280-1435-2) manufactured by 3M Co. of St. Paul, Minn. is used as the fillant 124. This epoxy is applied to the housing 106 with a 3M Scotch-Weld ® EPX applicator and mixing gun.

The blocking member 122 performs the same basic function as the O-ring 34 discussed above. Specifically, the blocking member 122 prevents the fillant 124 from coming into contact with the glass body 108 of the reed switch 102. Furthermore, the blocking member 122 supports and suspends the reed switch 102 in the center of the cavity 104 while the fillant 124 is curing. The design of the blocking member 122, however, is improved over the O-ring 34 discussed above.

Figure 6A:
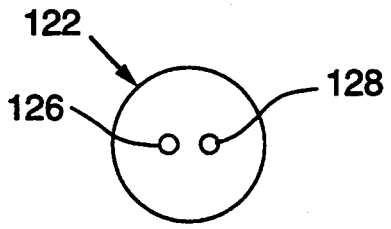
FIG. 6 is a front and side view of the blocking member shown in FIG. 5.
Figure 6B:
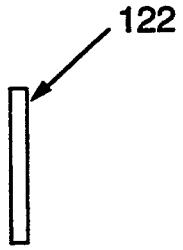

Referring to FIG. 6, the blocking member 122 is preferably in the shape of a bladder, similar to a diaphragm. The blocking member 122 is flat, circular in shape, and is manufactured by stamping out a circular piece of rubber sheet stock. The rubber used is preferably the basic O-ring type Nitrile rubber. By way of example, durometer 60D sheet rubber may be used to make the blocking member 122 The blocking member 122 preferably has a diameter of 6.36 millimeters (mm) and a thickness of 0.80 mm.

The blocking member 122 has two holes 126 and 128 through which the wires 110 and 112 extend. The holes 126 and 128 preferably have diameters of 1.0 mm each and are evenly spaced from the center of the blocking member 122. Because they are evenly spaced from the center of the blocking member 122, the holes 126 and 128 position the wires 110 and 112 generally in the center of the open end 120 of the housing 106. Centering the wires 110 and 112 in the open end 120 insures that the fillant 124 completely surrounds and covers the PVC plastic jacket of each of the wires 110 and 112. Completely surrounding each of the wires 110 and 112 with the fillant 124 insures a moisture proof seal for the cavity 104 in the housing 106. Protecting the reed switch 102 from moisture promotes its longevity.

The bladder shape of the blocking member 122 more thoroughly prevents the fillant 124 from seeping into the cavity 104 than the O-ring 34 discussed above. While the O-ring 34 normally prevents such seepage, it is possible that some of the fillant 36 will seep through the center hole in the O-ring 34 before the fillant 36 has hardened. Such seepage is possible because the wires 30 and 32 do not completely fill the center hole in the O-ring 34. The two holes 126 and 128 in the bladder shaped blocking member 122 fit tightly around the wires 110 and 112, respectively, and prevent seepage of the uncured fillant 124.

Preventing seepage of the fillant 124 into the cavity 104 is important because, as discussed above, it is preferred that none of the fillant 124 come into contact with the glass body 108 of the reed switch 102. Rather, the reed switch 102 should be surrounded by an air filled cavity 104 so that mechanical stresses on the housing 106 are not transferred to the glass body 108. This creates a "crush proof housing" because the housing 106 may be compressed a certain amount without breaking the glass body 108 of the reed switch 102.

The bladder shaped blocking member 122 also does a better job than the O-ring 34 of supporting and suspending the reed switch 102 in the center of the cavity 104 while the fillant 124 is curing. Specifically, it is preferred that the hardened fillant 124 support and suspend the reed switch 102, via the wires 110 and 112, in the center of the cavity 104 such that no part of the reed switch 102 makes contact with the cavity walls. While the hardened fillant 124 alone can adequately support the reed switch 102, the reed switch 102 needs to be supported in some other manner while the fillant 124 is curing. If the reed switch 102 is not supported during the curing period, it may rest on one of the cavity 104 walls and be permanently positioned there after the fillant 124 is cured. Thus, another function of the blocking member 122 is to provide such support while the fillant 124 is curing.

The bladder shaped blocking member 122 more adequately supports the reed switch 102 than the O-ring 34 due to the holes 126 and 128 in the blocking member 122. The holes 126 and 128 provide a tighter fit around the wires 110 and 112 than the single hole in the center of the O-ring 34. The tighter fitting holes 126 and 128 provide less of an opportunity for the reed switch 102 to rest on one of the cavity 104 walls.

In addition to the improved blocking member 122, the protective reed switch housing 100 also has other advantages over the protective reed switch housing 22 with respect to the so called "make-gap" and "break-gap" distances. Specifically, referring to FIG. 5, when an external magnet 130 is brought close to the housing 106 along its longitudinal axis, the magnetic flux density lines 132 created by the external magnet 130 cause the reed switch 102 reeds 134 and 136 to make contact. As explained above, when the reed switch 102 reeds 134 and 136 make contact, a circuit connected to the wires 110 and 112 is closed.

When the protective reed switch housing 100 is used in connection with a burglar alarm, the housing 106 is mounted in a door or window frame. The external magnet 130 is mounted to the door or window such that, when the door or window is closed, the external magnet 130 is positioned very close to the housing 106. In this position, the intensity of the magnetic flux density lines 132 is sufficient to cause the reeds 134 and 136 to make contact such that the circuit connected to the wires 110 and 112 is closed. When the door or window is opened, for example, by a burglar, the external magnet 130 moves away from the housing 106. As the distance G between the external magnet 130 and the housing 106 increases, the magnetic flux density 132 in the vicinity of the reed switch 102 gets weaker. At some point the distance G is large enough such that the reeds 134 and 136 separate. At this point, the circuit connected to the wires 110 and 112 opens and a burglar alarm is normally activated.

As the external magnet 130 moves toward the housing 106, the largest distance G between the external magnet 130 and the housing 106 at which the magnetic flux density 132 becomes strong enough to cause the reeds 134 and 136 to make contact is called the "make-gap" distance. As the external magnet 130 moves away from the housing 106, the distance G between the external magnet 130 and the housing 106 at which the magnetic flux density 132 becomes weak enough to cause the reeds 134 and 136 to separate is called the "break-gap" distance.

In general, a large make-gap and break-gap distance is desirable because it leaves room for error in the installation of the housing 106 in a door or window frame. Specifically, often times the housing 106 is not installed in exact alignment with the external magnet 130. When the door or window is closed, the distance G is greater than it would be if the housing 106 and external magnet 130 were perfectly aligned. However, if the make-gap distance is large, then the magnetic flux density 132 will still be strong enough to close the reeds 134 and 36, even though there is some misalignment.

It has been found that a make-gap distance of at least 0.75 inches is desirable. One factor that influences the magnitude of the make-gap distance is the strength of the external magnet 130. By way of example, the external magnet 130 may be a fully saturated magnet made of either Alnico 5 composite magnetic material or a Ceramic-Ferrite magnetic material. When the preferred external magnet 130 is used with the reed switch 102, the make-gap distance is normally approximately 0.75 inches.

Another factor that influences the magnitude of the make-gap and break-gap distances is the positioning of the reed switch 102 leads 114 and 116 with respect to the magnetic flux 132 created by the external magnet 130. Specifically, the leads 114 and 116 provide flux paths so that they are the primary component of the reed switch 102 which transfer the magnetic force created by the magnetic flux density 132 to the reeds 134 and 136. For the reeds 134 and 136 to make contact, the leads 114 and 116 should be exposed to the magnetic flux 132. That is, the leads 114 and 116 should be positioned within the cavity 104 so to be in a region of higher magnetic flux density 132. In the embodiment shown in FIG. 5, the closer a point is to the external magnet 130, the higher the magnetic flux density 132. Thus, while the lead 116 is already in a high magnetic flux region, the lead 114 is shown purposefully extended into and toward such high flux region. In such region the magnetic flux density will be higher than a region at the bottom of FIG. 5, which is more distant from the external magnet 130. The distance between the leads 114 and 116 and the external magnet 130 determines the positioning of the leads 114 and 116 with respect to the magnetic flux 132. Therefore, the distance between the leads 114 and 116 and the external magnet 130 affects the make-gap distance.

As a safety measure to insure that the make-gap distance of the reed switch 102 and external magnet 130 is at least 0.75 inches, the lead 114 is left long. Specifically, rather than cutting the excess lead 114 length off just after the crimp and solder joint 138, the lead 114 is left intact so that it extends towards the closed end 118 of the housing 106. By extending the lead 114 towards the closed end 118, the lead 114 is closer to the external magnet 130 and extended further into the magnetic flux 132 created by the external magnet 130. Because the lead 114 is extended further into the magnetic flux 132, the make-gap distance is insured to be at least 0.75 inches and is possibly even increased a small amount. Preferably, the lead 114 extends back over the reed switch 102 towards the closed end 118 approximately one-half to two-thirds the length of the glass body 108 of the reed switch 102. Specifically, the leads 114 and 116 are bent so that they are each substantially parallel to their respective reeds 134 and 136 and so that they lie in planes that are not coplanar with the flat portions of the reeds 134 and 136. In other words, the leads 114 and 116 preferably do not lie in the same plane as the flat portion of the reeds 134 and 136; rather, the leads 114 and 116 are preferably positioned directly above the flat portion of the reeds 134 and 136. Furthermore, the wire 110 is attached to the lead 114 at the solder joint 138, or the connection point 138. The connection point 138 is preferably spaced apart from the free end 115 of the lead 114 a distance equal to at least one-half the total length of the lead 114.

Although the lead 114 itself is preferably left long, it is believed possible that the lead 114 could be cut off just after the crimp and solder joint 138 and that another piece of wire could be connected to the crimp and solder joint 138 that extends into the magnetic flux 132. Furthermore, if the conductor in the wire 110 is stiff enough, it could be used to extend into the magnetic flux 132. In these scenarios, the extra piece of wire or the conductor of the wire 110 would provide a flux path to the actual lead 114 to transfer the magnetic force created by the magnetic flux density 132 to the reed 134.

Figure 7:
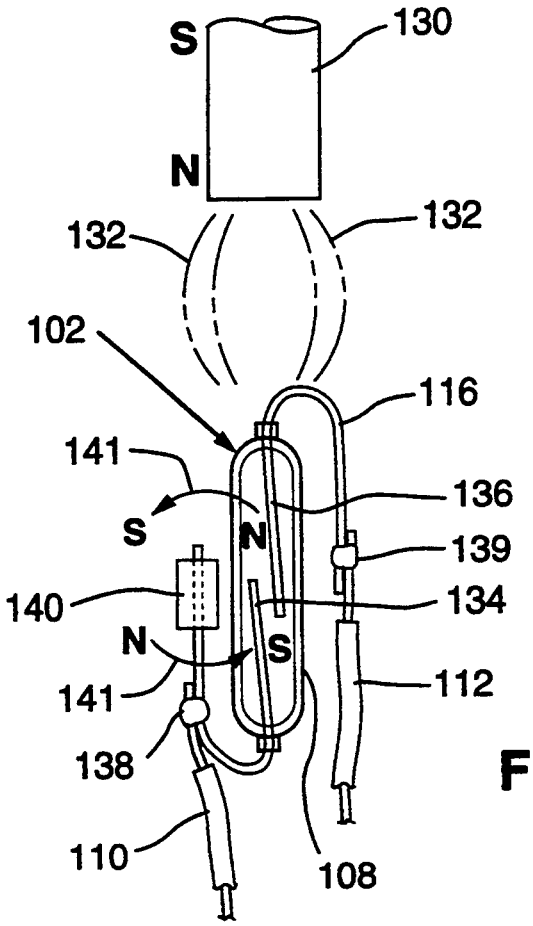
FIG. 7 is a side view illustrating the operation of an ameliorator magnet on the lead of the reed switch shown in FIG. 5.

Referring to FIG. 7, another way to increase the make-gap and break-gap distances is to secure a small "ameliorator" (bias or helper) magnet 140 to the extended part of the lead 114. The ameliorator magnet 140 is placed on the free end of the reed switch 102 lead 114 after it is bent into a position along side the reed switch glass body 108. The ameliorator magnet 140 decreases the required amount of magnetic flux density 132 created by the external magnet 130 that is needed to cause the reeds 134 and 136 to make contact. Because the reeds 134 and 136 can make contact with less magnetic flux density 132, both the make-gap and break-gap distances are increased. Use of the ameliorator magnet 140 to increase the make-gap and break-gap distances causes the reed switch 102 to be a so-called "wide-gap" magnetic contact.

The ameliorator magnet 140 preferably has a cylindrical shape having a diameter of 3 mm and a height of 3.175 mm. It is a pre-magnetized fully saturated magnet that is formed from pre-magnetized flexible ferrite sheet stock.

The ameliorator magnet 140 is pushed onto the extended lead 114 so that it is in close proximity to the portion of the reeds 134 and 136 which make contact. The ameliorator magnet 140 increases the make-gap and break-gap distances by priming the system with magnetic gauss. Specifically, the ameliorator magnet 140 induces opposing poles in each of the reeds 134 and 136. The induced poles in the reeds 134 and 136 bias the magnetic poles of the reed switch lead 114 to create an actual magnetic circuit 141 that operates at the magnetic flux density gauss level of the ameliorator magnet 140. A north pole is induced in the reed 136 which is the same pole as the closest portion of the external magnet 130. The magnetic flux density at the lead 114 pole is dependent on the gauss level of the ameliorator magnet 140. As the magnetic flux density 132 created by the external magnet 130 is introduced, the gauss level of the magnetic circuit 141 created by the ameliorator magnet 140 increases which causes the reeds 134 and 136 to make contact and close the electrical circuit connected to the wires 110 and 112. The greater the gauss level of the ameliorator magnet 140, the less magnetic flux density 132 required to close the reeds 134 and 136, and the greater the make-gap and break-gap distances.

The ameliorator magnet 140 creates an actual magnetic circuit 141 between itself and the reeds 134 and 136 rather than just inducing a higher level of magnetic flux into one of the reeds 134 or 136. If, instead, a higher level of magnetic flux is simply induced into one of the reeds 134 or 136, then when the external magnet 130 magnetic flux 132 is introduced, the magnetic flux density near that one of the reeds 134 and 136 is greatly increased. This simply increases the required magnetic flux density required for the reeds 134 and 136 to make contact and also creates a situation where reed latching may occur. Reed latching is when the reeds 134 and 136 stick together even after the external magnet 130 is moved away from the reed switch 102 a distance greater than the break-gap distance.

The magnetic flux density in the reed switch 102 magnetic circuit 141 created by the ameliorator magnet 140 can be adjusted by moving the ameliorator magnet 140 along the reed switch 102 lead 114. This is a more efficient means of adjusting the magnetic flux density than actually altering the magnetization of the ameliorator magnet 140. If the ameliorator magnet 140 is moved away from the ends of the reeds 134 and 136, the gauss level of the magnetic circuit 141 is decreased. By decreasing the gauss level, the make-gap and break-gap distances are decreased.

One advantage of being able to adjust the magnetic flux density in the reed switch 102 in this manner is to accommodate for variances in the sensitivity of the reed switch 102 itself. Different reed switches require differing levels of magnetic flux density to cause the reeds to make contact. The sensitivity of a reed switch is measured by placing a magnetic coil over the reed switch and determining the "Ampere-Turns (A-T) sensitivity rating" of the reed switch. The lower the A-T rating, the more sensitive the reed switch. For example, a reed switch having an A-T rating of 10 requires less magnetic flux density to close its reeds than a reed switch having an A-T rating of 15.

As a cost cutting measure, reed switches are often purchased in large quantities in which the individual reed switches have a range of ampere-turns ratings, such as 10–15 A-T. A manufacturer must use these varying sensitivity reed switches to construct reed switch assemblies that have specific advertised make-gap and break-gap distances. Such specific make-gap and break-gap distances can be guaranteed by adjusting the ameliorator magnet 140 to accommodate for the variances in the sensitivities of the reed switches.

For example, for a reed switch that is very sensitive, such as 10 A-T, the ameliorator magnet 140 would be pushed farther onto the lead 114 in order to position the ameliorator magnet 140 farther from where the reeds 134 and 136 come together. By positioning the ameliorator magnet 140 farther from where the reeds 134 and 136 come together, the flux density of the magnetic circuit 141 is reduced which causes the make-gap and break-gap distances to decrease. On the other hand, for a reed switch that is less sensitive, such as 15 A-T, the ameliorator magnet 140 would be positioned closer to the end of the lead 114 in order to place the ameliorator magnet 140 closer to where the reeds 134 and 136 come together. By positioning the ameliorator magnet 140 closer to where the reeds 134 and 136 come together, the flux density of the magnetic circuit 141 is increased which causes the make-gap and break-gap distances to increase.

The ameliorator magnet 140 is designed so that it slides on the reed switch 102 lead 114 very tightly. Specifically, a hole having a diameter slightly smaller than the lead 114 is drilled through the center of the ameliorator magnet 140. The premagnetized flexible ferrite sheet stock that the ameliorator magnet 140 is preferably made from is a rubberized material that is capable of flexing. Thus, the ameliorator magnet 140 squeezes the lead 114 to remain stationary, but the flexing of the material can allow the ameliorator magnet 140 to be moved if force is applied.

Once the ameliorator magnet 140 is positioned correctly on the reed switch assembly 100 and placed into the plastic housing 106, it will normally not be moved and the plastic housing 106 will be sealed by the fillant 124 for the end user's use. The ameliorator magnet 140 normally cannot be moved by vibration or installer mishandling which insures that the advertised preset make-gap and break-gap distances will not be altered during usage.

Figure 8A:
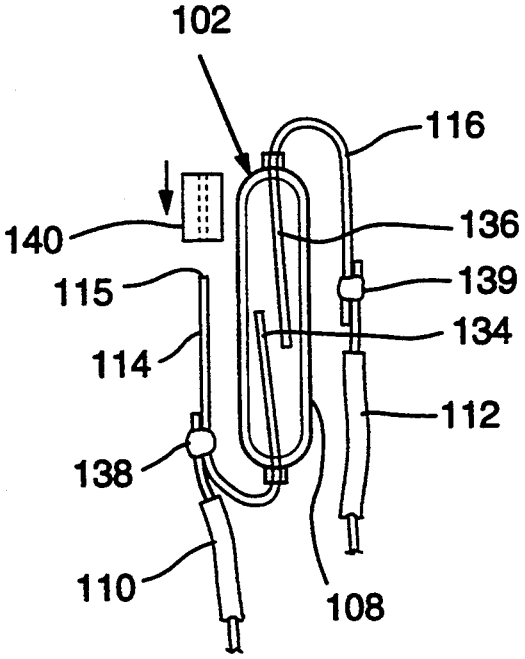
FIG. 8 is a front and side view illustrating the positioning of the leads and the placement of the ameliorator magnet on the reed switch shown in FIG. 5.
Figure 8B:
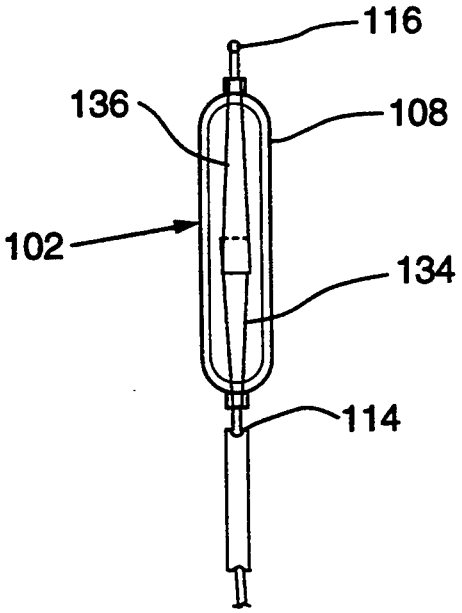

The present invention also includes a method for enclosing the reed switch 102 in the protective housing 106. Referring to FIG. 8, rather than cutting the leads 114 and 116 off near the glass body 108, the leads 114 and 116 are bent over the reed switch 102 body 108 so that they are parallel to the flat portion of the reeds 134 and 136, respectively. Specifically, the leads 114 and 116 are bent so that they lie in planes that are not coplanar with the flat portions of the reeds 134 and 136. The lead 114 preferably has a length that is long enough so that it extends approximately one-half to two-thirds the length of the reed switch 102 glass body 108 towards the lead 116.

The wire 110 is attached to the lead 114 at a location such that at least one-half the total length of the lead 114 measured from the free end 115 is exposed. The wire 110 is attached to the lead 114 at the solder joint 138, or the connection point 138. The connection point 138 is preferably spaced apart from the free end 115 of the lead 114 a distance equal to at least one-half the total length of the lead 114. The wire 112 is attached to the end of the lead 116. The wires 110 and 112 are preferably twenty-two gage wire and are attached to the leads 114 and 116 by crimping and soldering to form the crimp and solder joints 138 and 139.

If the ameliorator magnet 140 is to be used, it is pushed onto the free end 115 of the lead 114. The exposed portion of the lead 114 is for receiving and, as discussed above, allowing for some adjustment of the position of the ameliorator magnet 140. It should be understood, however, that the use of the ameliorator magnet 140 to create the so called "widegap" contacts is optional.

The wires 110 and 112 are inserted through the holes 126 and 128 in the blocking member 122. The blocking member 122 is positioned on the same side of the reed switch 102 body 108 as the lead 114.

The reed switch 102 is then inserted into the open end 120 of the housing 106. The lead 116 is inserted first so that the wires 110 and 112 extend out of the open end 120. The reed switch 102 and the blocking member 122 are pushed into the housing 106 until the reed switch 102 body 108 and the blocking member 122 are positioned completely within the housing 102. Furthermore, the blocking member 122 should define a space between itself and the open end 120 of the housing 106.

Lastly, the space between the blocking member 122 and the open end 120 is substantially filled with the fillant 124. As discussed above, the fillant 124 is preferably an epoxy adhesive.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. A reed switch assembly, comprising:

an elongate hollow housing having an opening at one end thereof for access to a cavity therein;

a reed switch having a body, a first connecting lead having one end connected to a first flat reed and another end free, and a second connecting lead having one end connected to a second flat reed and another end free, the first connecting lead being bent so that it is substantially parallel to the first reed and so that it lies in a plane that is not coplanar with the flat portion of the first reed, the reed switch being positioned completely inside the cavity;

first and second wires attached to the first and second connecting leads, respectively, the first wire being attached to the first connecting lead at a connection point that is spaced apart a distance from the free end of the first connecting lead, the first and second wires extending through the opening in the housing;

a blocking member positioned inside the cavity between the reed switch body and the housing opening to define a space between itself and the housing opening, the first and second wires extending through the blocking member, the blocking member providing support for the reed switch and substantially centering the reed switch in the housing cavity; and fillant positioned in the cavity at the housing opening for substantially closing the housing opening, the fillant extending into the cavity up to the blocking member and surrounding the first and second wires to suspend the reed switch in the cavity such that the reed switch body and the first and second connecting leads do not make contact with the housing, the blocking member preventing the fillant from contacting the reed switch body.

2. The reed switch assembly of claim 1, further comprising:

a magnet mounted on the first connecting lead between the free end and the connection point to create a magnetic circuit between itself and the first and second reeds in order to reduce the magnetic flux density required to close the first and second reeds.

3. The reed switch assembly of claim 1, wherein the first connecting lead has a length that is long enough so that the first connecting lead extends at least half-way over the reed switch body towards the second connecting lead.

4. The reed switch assembly of claim 1, wherein the distance between the connection point and the free end of the first connecting lead is equal to at least one-half the total length of the first connecting lead.

5. The reed switch assembly of claim 1, wherein the blocking member comprises a substantially flat, circular piece of rubber having two holes through which the first and second wires extend.

6. The reed switch assembly of claim 1, wherein the blocking member comprises an O-ring.

7. The reed switch assembly of claim 1, wherein the fillant comprises epoxy adhesive.

8. A reed switch assembly, comprising:

an elongate hollow housing having an opening at one end thereof for access to a cavity therein;

a reed switch having a body, a first connecting lead having one end connected to a first flat reed and another end free, and a second connecting lead having one end connected to a second flat reed and another end free, the first and second connecting leads being bent so that they are each substantially parallel to their respective first and second reeds and so that they lie in planes that are not coplanar with the flat portions of the first and second reeds, the first connecting lead having a length that is long enough so that it extends at least half-way over the reed switch body towards the second connecting lead, the reed switch being positioned completely inside the cavity;

first and second wires attached to the first and second connecting leads, respectively, the first wire being attached to the first connecting lead at a connection point that is spaced apart from the free end of the first connecting lead a distance equal to at least one-half the total length of the first connecting lead, the first and second wires extending through the opening in the housing;

a magnet mounted on the first connecting lead between the free end and the connection point to create a magnetic circuit between itself and the first and second reeds in order to reduce the magnetic flux density required to close the first and second reeds;

a blocking member positioned inside the cavity between the reed switch body and the housing opening to define a space between itself and the housing opening, the blocking member being a substantially flat, circular piece of rubber having two holes through which the first and second wires extend, the blocking member providing support for the reed switch and substantially centering the reed switch in the housing cavity; and fillant positioned in the cavity at the housing opening for substantially closing the housing opening, the fillant extending into the cavity up to the blocking member and surrounding the first and second wires to suspend the reed switch in the cavity such that the reed switch body and the first and second connecting leads do not make contact with the housing, the blocking member preventing the fillant from contacting the reed switch body.

9. The reed switch assembly of claim 8, wherein the first and second wires are attached to the first and second connecting leads by crimping and soldering.

10. A method for enclosing a reed switch within an elongate hollow protective housing having an open end, the reed switch having a body, a first connecting lead, and a second connecting lead, the first and second connecting leads having corresponding first and second wires attached thereto, said method comprising the steps of:

surrounding the first and second wires with a blocking member in the vicinity of the first connecting lead;

inserting the reed switch, second connecting lead first, into the open end of the protective housing;

pushing the reed switch and the blocking member into the protective housing until the body and the blocking member are positioned completely within the protective housing, and so that the blocking member defines a space between itself and the open end of the protective housing; and substantially filling the space between the blocking member and the open end of the protective housing with a fillant so that the fillant surrounds the first and second wires to suspend the reed switch in the protective housing such that the reed switch body and the first and second connecting leads do not make contact with the protective housing.

11. The method of claim 10, wherein the blocking member comprises an O-ring.

12. The method of claim 10, wherein the blocking member comprises a substantially flat, circular piece of rubber having two holes therethrough for receiving the first and second wires.

13. The method of claim 10, wherein the fillant comprises epoxy adhesive.

14. A method for enclosing a reed switch within an elongate hollow protective housing having an open end, the reed switch having a body, a first connecting lead having one end connected to a first flat reed and another end free, and a second connecting lead having one end connected to a second flat reed and another end free, the method comprising the steps of:

bending the first and second connecting leads so that they are each substantially parallel to their respective first and second reeds and so that they lie in planes that are not coplanar with the flat portions of the first and second reeds;

attaching a first wire to the first connecting lead at a connection point that is spaced apart a distance from the free end of the first connecting lead;

attaching a second wire to the second connecting lead;

inserting the first and second wires through a blocking member, the blocking member being positioned on the same side of the reed switch body as the first connecting lead;

inserting the reed switch, second connecting lead first, into the open end of the protective housing;

pushing the reed switch and the blocking member into the protective housing until the reed switch body and the blocking member are positioned completely within the protective housing, and so that the blocking member defines a space between itself and the open end of the protective housing; and substantially filling the space between the blocking member and the open end of the protective housing with a fillant.

15. The method of claim 14, further comprising the step of:

pushing an ameliorator magnet onto the free end of the first connecting lead.

16. The method of claim 14, wherein the first connecting lead has a length that is long enough so that the first connecting lead extends at least halfway over the reed switch body towards the second connecting lead.

17. The method of claim 14, wherein the distance between the connection point and the free end of the first connecting lead is equal to at least one-half the total length of the first connecting lead.

18. The method of claim 14, wherein the blocking member comprises a substantially flat, circular piece of rubber having two holes therethrough for receiving the first and second wires.

19. The method of claim 14, wherein the blocking member comprises an O-ring.

20. The method of claim 14, wherein the fillant comprises epoxy adhesive.

21. A method for enclosing a reed switch within an elongate hollow protective housing having an open end, the reed switch having a body, a first connecting lead having one end connected to a first flat reed and another end free, and a second connecting lead having one end connected to a second flat reed and another end free, the method comprising the steps of:

bending the first and second connecting leads so that they are each substantially parallel to their respective first and second reeds and so that they lie in planes that are not coplanar with the flat portions of the first and second reeds, the first connecting lead having a length that is long enough so that the first connecting lead extends at least half-way over the reed switch body towards the second connecting lead;

attaching a first wire to the first connecting lead at a connection point that is spaced apart from the free end of the first connecting lead a distance equal to at least one-half the total length of the first connecting lead;

attaching a second wire to the second connecting lead;

pushing an ameliorator magnet onto the free end of the first connecting lead;

inserting the first and second wires through a blocking member, the blocking member being positioned on the same side of the reed switch body as the first connecting lead;

inserting the reed switch, second connecting lead first, into the open end of the protective housing;

pushing the reed switch and the blocking member into the protective housing until the reed switch body and the blocking member are positioned completely within the protective housing, and so that the blocking member defines a space between itself and the open end of the protective housing; and substantially filling the space between the blocking member and the open end of the protective housing with a fillant.

22. The method of claim 21, wherein the first and second wires are attached to the first and second connecting leads by crimping and soldering.

23. The method of claim 21, wherein the blocking member comprises a substantially flat, circular piece of rubber having two holes therethrough for receiving the first and second wires.

24. The method of claim 21, wherein the blocking member comprises an O-ring.

25. The method of claim 21, wherein the fillant comprises epoxy adhesive.

* * * * *